US008959825B2

(12) United States Patent
Goertzen

(10) Patent No.: US 8,959,825 B2
(45) Date of Patent: Feb. 24, 2015

(54) ACCESSORY MOUNTING APPARATUS AND SYSTEM

(76) Inventor: Reiner Goertzen, Newberg, OR (US)

( * ) Notice: Subject to any disclaimer, the term of this patent is extended or adjusted under 35 U.S.C. 154(b) by 1 day.

(21) Appl. No.: 13/534,630

(22) Filed: Jun. 27, 2012

(65) Prior Publication Data

US 2013/0000176 A1 Jan. 3, 2013

Related U.S. Application Data

(60) Provisional application No. 61/502,978, filed on Jun. 30, 2011.

(51) Int. Cl.
*F41G 11/00* (2006.01)

(52) U.S. Cl.
CPC ..... *F41G 11/001* (2013.01); *F41G 11/003* (2013.01)
USPC ..... 42/127; 42/124

(58) Field of Classification Search
CPC ..... F41G 1/00; F41G 1/16; F41G 1/38; F41G 1/387; F41G 11/00; F41G 11/001; F41G 11/003; F41G 11/004
USPC ..... 42/90, 111, 124–127, 119, 114, 146
See application file for complete search history.

(56) References Cited

U.S. PATENT DOCUMENTS

| | | | | | |
|---|---|---|---|---|---|
| 2,803,880 | A * | 8/1957 | Weaver | 42/128 |
| 3,253,361 | A * | 5/1966 | Kingsbury | 42/124 |
| 3,260,001 | A * | 7/1966 | Weaver | 42/124 |
| 3,405,448 | A * | 10/1968 | Weatherby | 42/127 |
| 3,579,840 | A * | 5/1971 | Heinzel | 42/127 |
| 5,606,818 | A * | 3/1997 | Hardee | 42/124 |
| 5,680,725 | A * | 10/1997 | Bell | 42/127 |
| 6,922,934 | B1 * | 8/2005 | Huan | 42/127 |
| 6,931,778 | B1 * | 8/2005 | Nelson et al. | 42/120 |
| 7,107,716 | B1 * | 9/2006 | Liao | 42/108 |
| 7,272,904 | B2 | 9/2007 | Larue | |
| 7,712,242 | B2 * | 5/2010 | Matthews et al. | 42/90 |
| 7,739,824 | B1 * | 6/2010 | Swan | 42/124 |
| 7,814,698 | B2 | 10/2010 | Fluhr et al. | |
| 7,886,476 | B1 * | 2/2011 | Swan | 42/127 |
| 7,905,045 | B1 * | 3/2011 | Swan | 42/127 |
| 7,941,960 | B2 * | 5/2011 | Matthews et al. | 42/90 |
| 8,020,335 | B2 * | 9/2011 | Larsson et al. | 42/125 |
| 8,276,307 | B2 * | 10/2012 | Deros | 42/127 |
| 8,336,246 | B1 * | 12/2012 | Barber | 42/127 |
| 8,567,105 | B1 * | 10/2013 | Bobro | 42/90 |
| 2008/0155876 | A1 * | 7/2008 | Matthews et al. | 42/124 |
| 2010/0043271 | A1 * | 2/2010 | Williams et al. | 42/124 |
| 2010/0107467 | A1 * | 5/2010 | Samson et al. | 42/127 |
| 2011/0167703 | A1 * | 7/2011 | Deros | 42/90 |
| 2011/0173866 | A1 * | 7/2011 | Matthews et al. | 42/90 |

* cited by examiner

*Primary Examiner* — Jonathan C Weber
(74) *Attorney, Agent, or Firm* — Hancock Hughey LLP

(57) ABSTRACT

Apparatus and system for mounting accessories to firearms and the like. More specifically, an apparatus and system for mounting accessories such as optics, sighting telescopes, lasers, thermal imaging devices, night vision devises, knives, cameras, flashlights and the like to firearms that have been fitted with a Picatinny mounting rail. The mounting apparatus is quickly secured to and removed from a Picatinny rail and provides a highly secure and stable mount for accessories. The apparatus and the accessories that are attached to it may be removed and replaced from the Picatinny rail repeatedly without affecting the preset sighting zero of the device.

8 Claims, 14 Drawing Sheets

ACCESSORY MOUNTING APPARATUS AND SYSTEM

FIELD OF THE INVENTION

This invention relates to an apparatus and system for mounting accessories to weapons, and more specifically, to an apparatus and system for mounting accessories such as optics, sighting telescopes, lasers, thermal imaging devices, night vision devises, knives, cameras, flashlights and the like to weapons such as firearms that have a Picatinny rail. The mounting apparatus is quickly secured to and removed from a Picatinny rail and provides a highly secure and stable mount for accessories. When the mount of the present invention is used to mount an accessory that requires or benefits from a sighting zero, the invention allows the accessory to be removed and replaced from the Picatinny rail repeatedly without affecting the preset sighting zero.

BACKGROUND

A Picatinny rail (MIL-STD-1913), which is also sometimes called a tactical rail is a standard bracket that is used on some firearms that provides a standardized mounting platform for accessories. Picatinny rails are used on many different types of firearms and were originally designed for mounting scopes. However, the rails are useful for mounting any number of different types of accessories, including but not limited to accessories such as optics, sighting telescopes, laser aiming modules, thermal imaging devices, night vision devises, knives, cameras, flashlights, foregrips, bipods, bayonets, and the like. Picatinny rails are used on many firearms, including innumerable types of rifles, and pistols.

The rail is a longitudinal member that is mounted to the weapon. The rail includes opposed side edges with a specific configuration and a series of ridges extending transverse to the longitudinal axis of the member; each ridge is separated from adjacent ridges with a spacing slot. The rails have very standardized size and spacing specifications.

There are numerous ways to mount a Picatinny rail to a firearm, depending to an extent on the specific firearm and stock. In many cases, the Picatinny rail is an integral and standard part of the firearm that is added by the manufacturer. Moreover, regardless of the manner of attachment, one or more Picatinny rails may be mounted to a firearm. For instance, three and sometimes four rails may be mounted at approximately 90 degree positions around the barrel and stock. Generally speaking, the Picatinny rail provides a very stable mounting platform that tends to dissipate heat as the barrel heats and cools, and therefore tends to not flex.

There are also many types of mounting devices designed for Picatinny rails. The mounting device provides an interface between an accessory device such as those mentioned above, and the rail, and attaches the accessory to the rail. The mounting apparatus typically spans the width of the rail and in some manner attaches to the opposed longitudinal edges of the rail, and has some kind of mechanism that locates the mounting apparatus relative to the transverse ridges. The mounting devices also include some kind of securing system by which the mounting device is secured to the rail, typically with some kind of quick release mechanism that enables the mounting device, and the accessory that is attached to it, to be quickly mounted to and released from the rail and thus the firearm.

For example, U.S. Pat. No. 7,272,904 describes an Adjustable Throw-Lever Picatinny Rail Clamp that utilizes a throw-lever releasable mounting system. Another example of a mounting device for a Picatinny rail is shown in U.S. Pat. No. 7,814,698, Connecting Pieces for Weapon Rails.

A closely associated and similar rail is known as the Weaver rail. A Weaver rail is structurally very similar to the Picatinny rail, but the transverse ridges of a Weaver rail are different from the Picatinny rail. Generally speaking, therefore, the present invention is a device to provide a mounting interface between a mounting rail—such as for example the Picatinny and Weaver rails—and an accessory device that is to mounted to the mounting rail. The term weapon rail is therefore used at times to refer generically to these types of mounting rails, although the rails are not limited to use with weapons.

Despite the mounting devices shown and described in the two patents just mentioned, there is a need for an improved and robust mounting apparatus for the Picatinny rail system.

The present invention relates to an improved design for a mounting apparatus for use with Picatinny rails and which is used to mount accessories to firearms. The mounting apparatus is quickly secured to and removed from a Picatinny rail and provides a highly secure and stable mount for accessories. When the mount of the present invention is used to mount an accessory that requires or benefits from a sighting zero, the present invention allows the accessory to be removed and replaced from the Picatinny rail repeatedly without affecting the preset sighting zero of the accessory.

BRIEF DESCRIPTION OF THE DRAWINGS

The invention will be better understood and its numerous objects and advantages will be apparent by reference to the following detailed description of the invention when taken in conjunction with the following drawings.

FIG. 1 is an upper perspective view of a single Picatinny rail.

FIG. 2 is a cross sectional view taken along the line 2-2 of FIG. 1.

FIG. 3 is a side elevation view of a portion of the Picatinny rail shown in FIG. 1.

FIG. 14 is a side and slightly perspective elevation view of the resilient clip member.

FIG. 15 is a perspective view of the resilient clip member.

FIG. 16 is an elevation view of the resilient clip member.

FIG. 17 is an end view of the resilient clip member.

FIG. 18 is a bottom view of the centering stud.

FIG. 19 is an upper perspective view of the centering stud.

FIG. 20 is a side view of the centering stud.

FIG. 21 is an end view of the centering stud.

FIGS. 22 through 34 are a series of views of the release knobs 122 according to the present invention. Specifically, In FIG. 22A the release knob is in the secured position whereby the release knob is locking the mount apparatus.

In FIG. 22B the release knob is shown in secure position so that the mount apparatus may not be removed from the rail to which it is attached.

FIG. 23 is a cross sectional and perspective view of the release knob with some components omitted from the drawing to show selected components.

FIG. 24 is a side perspective view of a release knob and a mounting apparatus.

FIG. 25 is an upper perspective and partially exploded view of a release knob, illustrating selected components.

FIG. 26 is a side view of the outer cylinder of a release knob.

FIG. 27 is an end view of the outer cylinder of a release knob.

FIG. 28 is a cross sectional view taken along the line 28-28 of FIG. 26 and including selected components of the release knob.

FIG. 29 is an end view of the release knob including selected components.

FIG. 30 is a cross sectional view taken along the line 30-30 of FIG. 29.

FIG. 31 is an upper perspective view of the outer cylinder of a release knob.

FIG. 32 is an end view of the gear knob component of the release knob.

FIG. 33 is a perspective view of the gear knob shown in FIG. 32.

FIG. 34 is an elevation view of the gear knob shown in FIG. 32.

FIG. 35 is a perspective view of the stud used to interconnect the release knob to the mounting apparatus.

FIG. 36 is a side view of the stud shown in FIG. 35.

FIG. 37 is an end view of the stud shown in FIG. 35.

FIG. 38 is a lower perspective view of an alternative embodiment in which a single release knob is utilized.

FIG. 39 is an upper perspective view of yet another alternative embodiment of the mount according to the present invention, in which the upper portion of the mount is adapted for mounting a specific device, in this case a sight sold under the trademark AIMPOINT, Micro T-1.

FIG. 40 is an upper perspective view of yet another alternative embodiment of the mount according to the present invention, in which the upper portion of the mount is adapted for mounting a specific device, in this case a flashlight sold under the trademark HALO.

DETAILED DESCRIPTION OF THE ILLUSTRATED EMBODIMENTS

The present invention relates to a mounting apparatus and system for quick and secure mounting of accessory devices to a Picatinny rail. As used herein, Picatinny rail identifies the well known type of rail sold under that name. However, it is to be understood that the present invention may be used with the similar Weaver rail as well, and that references to Picatinny rail herein should be construed as including other rail systems including the Weaver rail.

Figure 1:
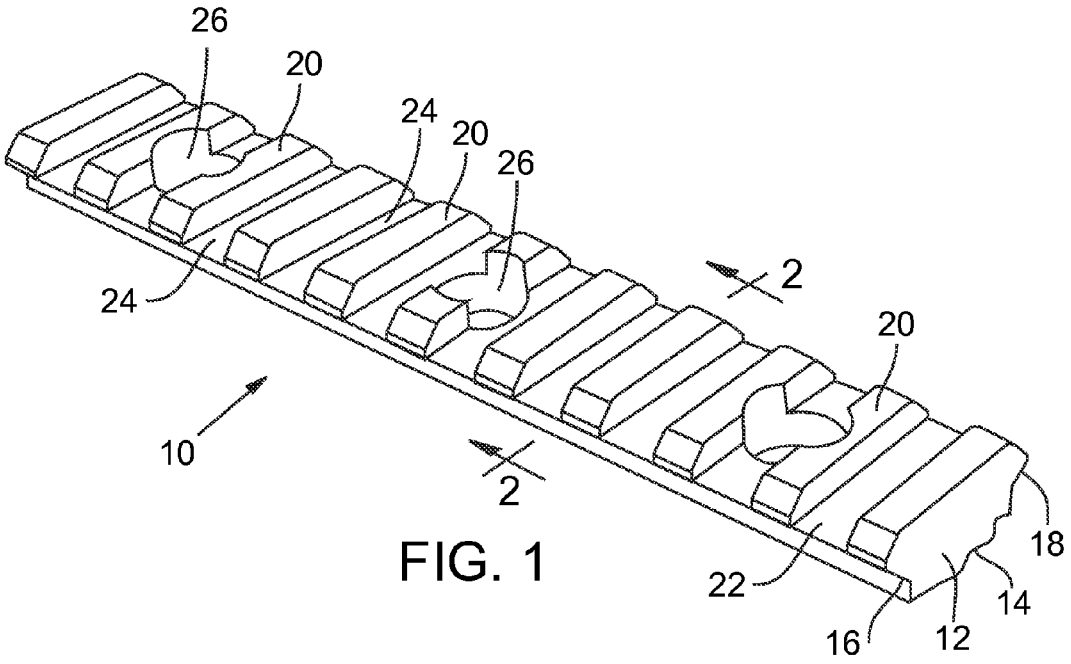
FIGS. 1, 2 and 3 are illustrations of a conventional Picatinny rail of the type referred to herein. Specifically.
Figure 2:
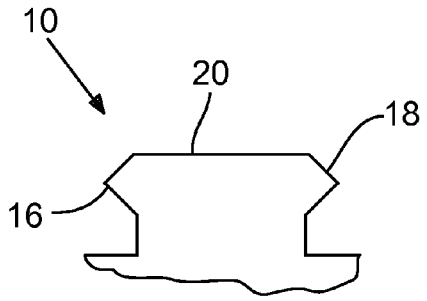
Figure 3:
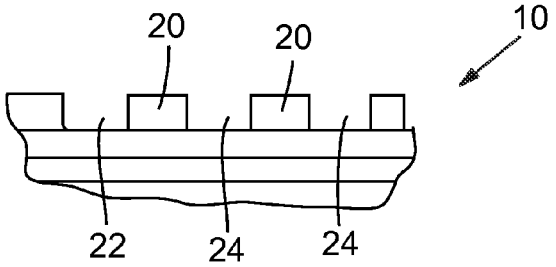

With reference to the series of FIGS. 1 through 3, a conventional Picatinny rail 10 is shown. The rail 10 is defined by an elongate body 12 that has a lower side base 14 and opposed longitudinal side edges 16 and 18 that extend linearly along the rail 10 and which are generally wedge shaped in cross sectional view as in FIG. 2. Plural transverse ridges 20 extend across the upper surface 22 of rail 10 and each transverse ridge 20 is separated from the adjacent transverse ridge by a space 24. There are a variety of ways to mount the rail 10 to a firearm, but one exemplary method is by affixing the rail 10 to a firearm barrel or stock with screws inserted through openings 26. Moreover, it is to be understood that a Picatinny rail is not limited in use to firearms, but instead may be used to mount accessories to a variety of devices, including but not limited to vehicles of all descriptions, all terrain vehicles, bicycles and motorcycles, trekking sticks, cameras, and in other applications for military and recreational uses.

Figure 4:
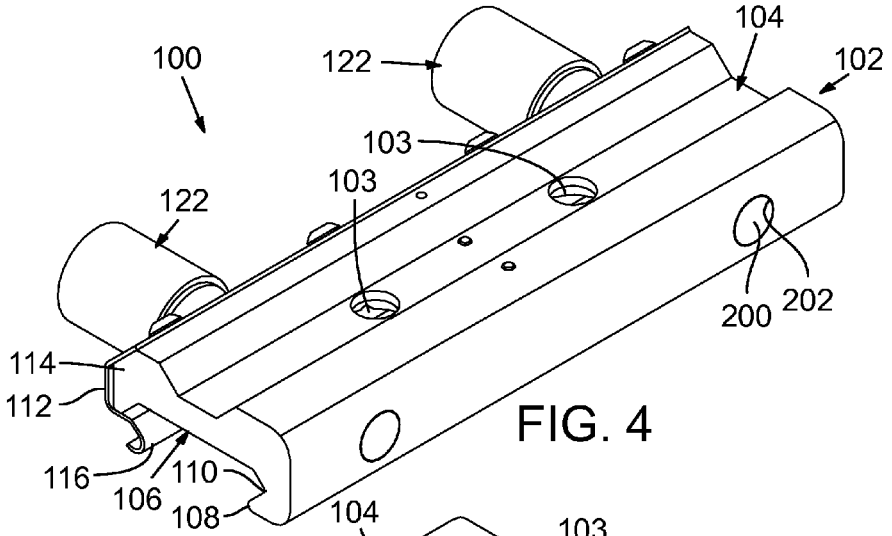
FIG. 4 is an upper perspective view of a first illustrated embodiment of the mounting apparatus according to the present invention.
Figure 5:
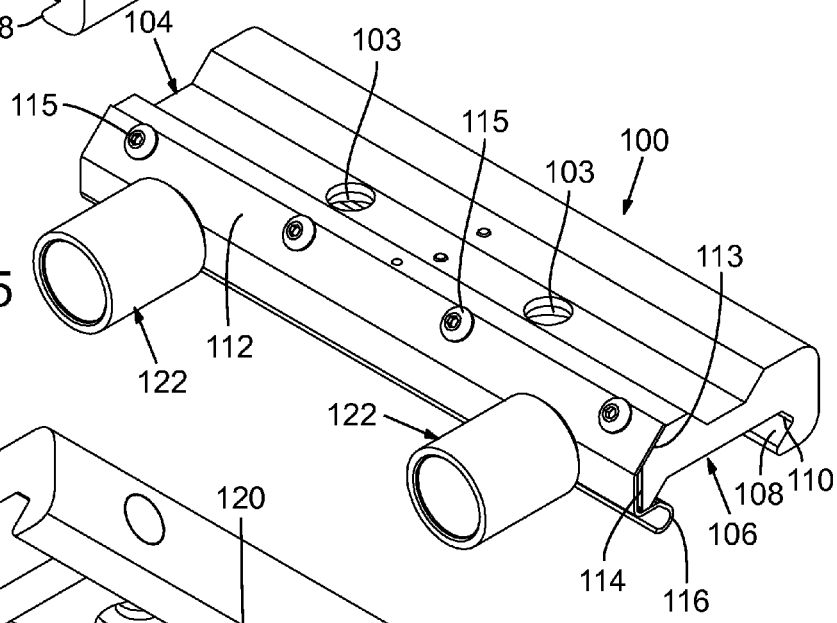
FIG. 5 is an upper perspective view of the mounting apparatus shown in FIG. 4, from the opposite side of the apparatus.
Figure 6:
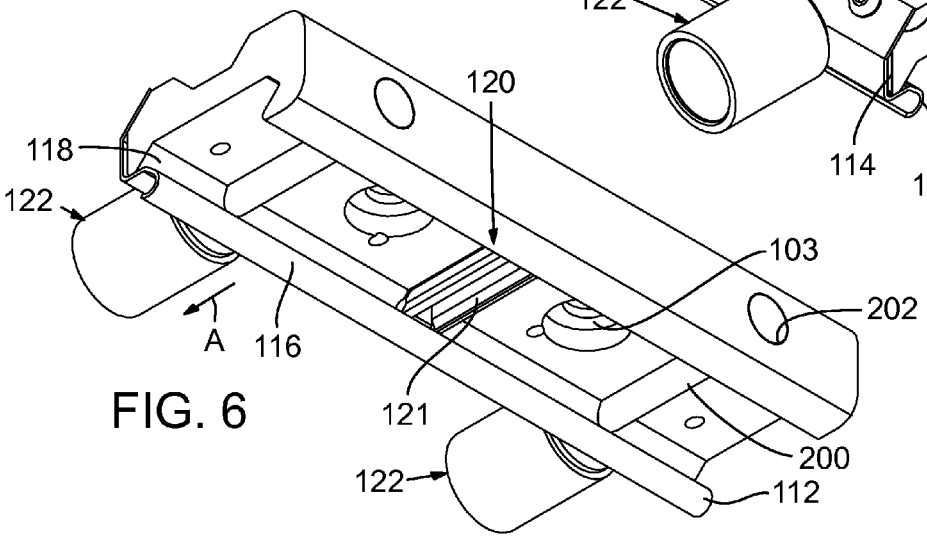
FIG. 6 is a lower perspective view of the mounting apparatus shown in FIG. 4.
Figure 7:
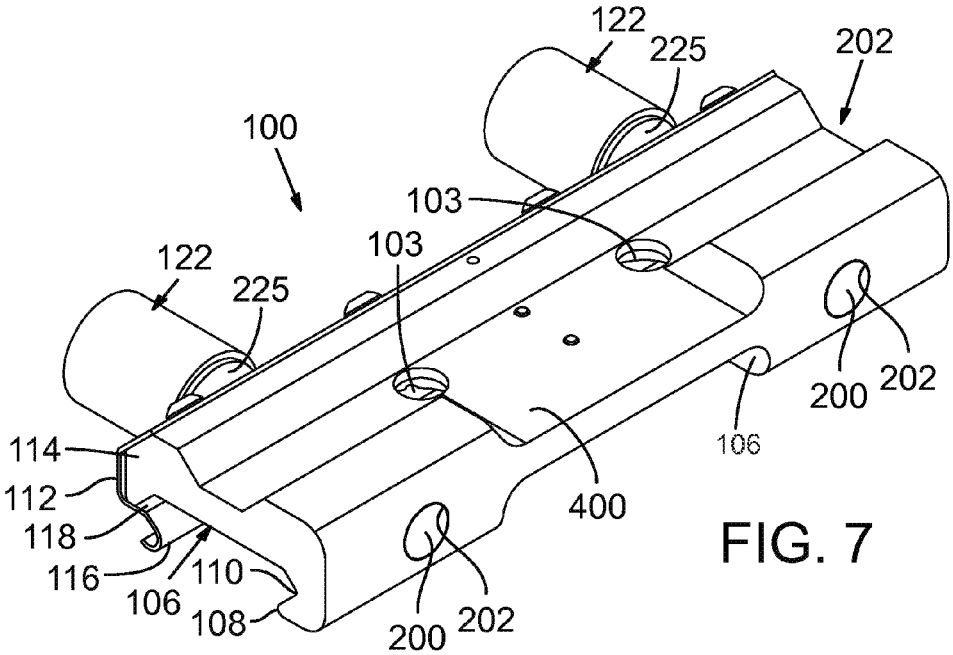
FIG. 7 is an upper perspective view of a second illustrated embodiment of the mounting apparatus according to the present invention.
Figure 8:
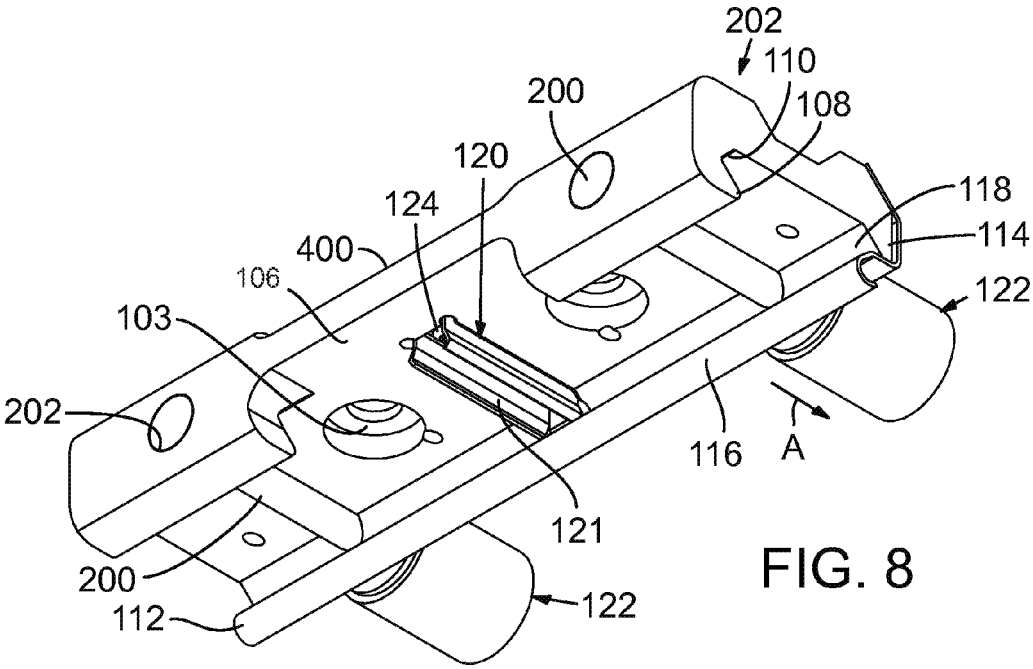
FIG. 8 is a lower perspective view of the embodiment of the mounting apparatus shown in FIG. 7.
Figure 9:
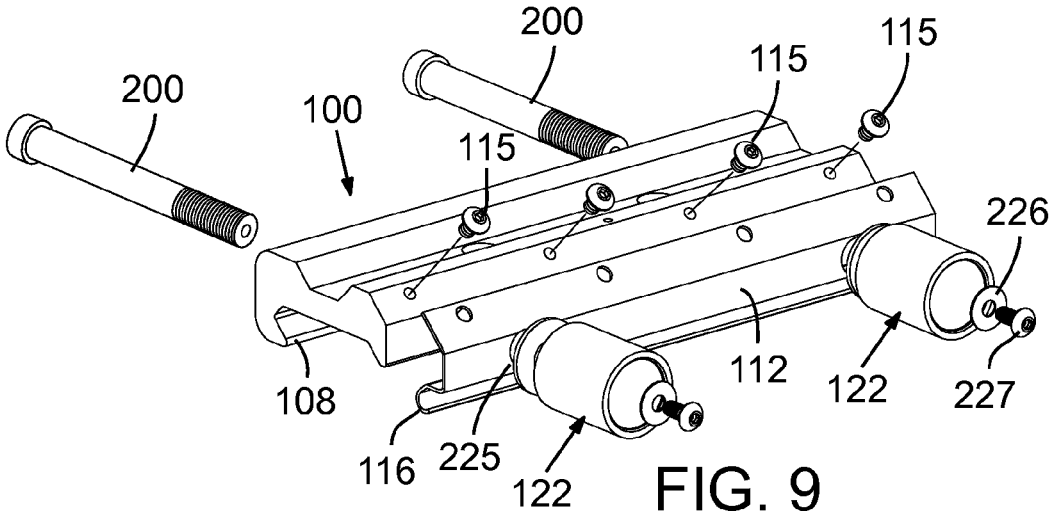
FIG. 9 is a perspective exploded view of the upper side of a mounting apparatus according to the present invention.

A first illustrated embodiment of the mounting apparatus and system according to the present invention is shown in FIGS. 4, 5 and 6. Apparatus 100 includes an elongate main body 102 that preferably is an extruded or machined part fabricated from aluminum or other appropriate alloy. The main body 102 has an upper surface 104 that serves as the general mounting area for an accessory device (such as those described above) and a lower surface 106 that defines the structures that attach the main body 102 to the Picatinny rail 10. The configuration of the upper surface 104 may be varied according to the attachment requirements and configuration of the specific accessory that the apparatus 100 is designed to mount. Some specific examples of mount apparatus 100 designed for different accessories are described herein and shown in the drawings, for example, FIGS. 39 and 40. Additionally, the alternative embodiment of a mount 100 shown in FIGS. 7 and 8 has an upper surface 400 that is configured for mounting a specific accessory.

Figure 13:
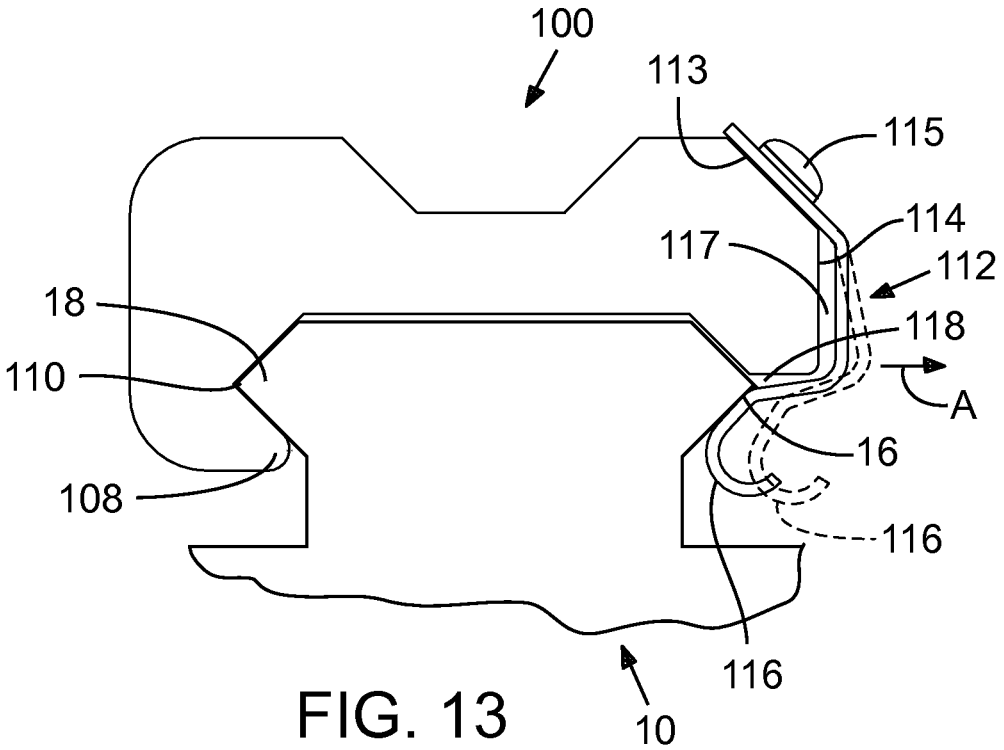
FIG. 13 is a cross sectional view through the main body portion of the mounting apparatus according to the present invention, mounted to a Picatinny rail to show the relative positions of the structures when mounted.
Figure 15:
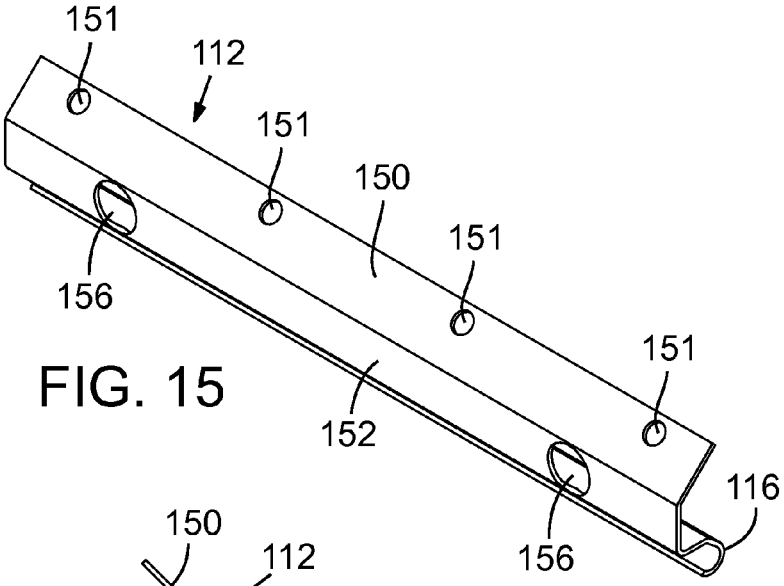
FIGS. 14 through 17 are a series of views of the resilient clip member 112 of the present invention. Specifically.
Figure 17:
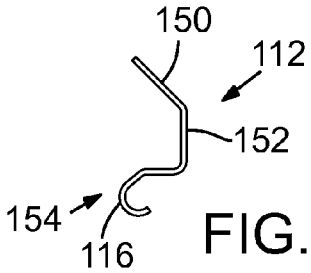
Figure 14:
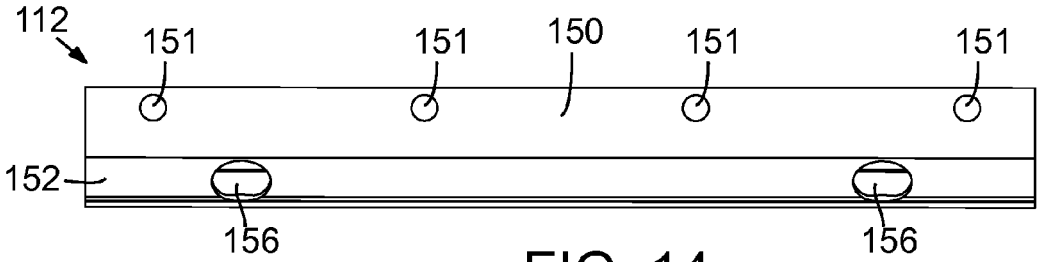
Figure 16:
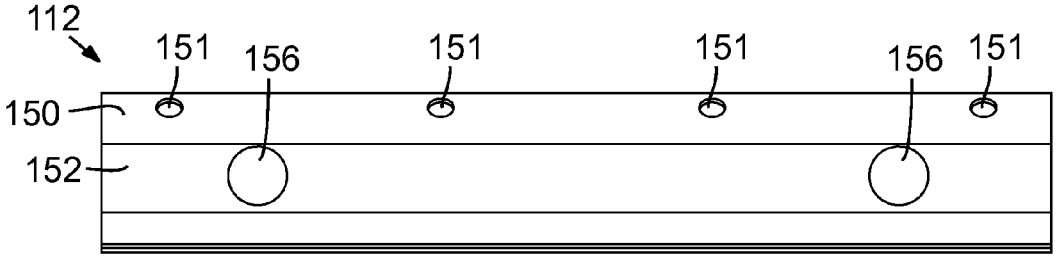
Figure 19:
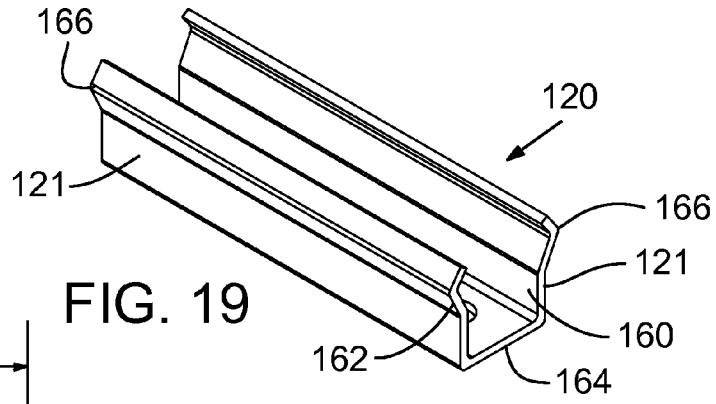
FIGS. 18 through 21 are a series of views of the centering stud 120 of the present invention. Specifically.

Returning to FIGS. 4, 5 and 6, lower surface 106 is defined by a first linear and longitudinally extending side edge 108 that is generally wedge shaped in cross section to define a wedge shaped linear groove 110 that is cooperatively shaped so that the wedge shaped longitudinal side edge 18 of rail 10 is received in groove 110 when apparatus 100 is attached to rail 10 (see, e.g., FIG. 13).

The opposite side of lower surface 106 has a similarly configured structure designed to engage the opposite longitudinal side edge 16 of rail 10 when apparatus 100 is attached to rail 10. However, the opposite side of lower surface 106 utilizes an elongate resilient clip member 112 that is attached to the side surface 114 of main body 102 and which defines a robust and resilient hinge mechanism. Resilient clip member 112 is attached securely to side surface 114 of main body 102 along an angled or sloped upper edge portion 113 of the main body with plural fasteners such as rivets 115 (or equivalent screws, spot welding, adhesive, etc.). The clip member 112 has a lower portion that defines a side edge 116 that is shaped to define a rounded edge that is cooperatively shaped to (a) slip over longitudinal side edge 16 of rail 10 when the apparatus 100 is mounted to rail 10, and (b) engage side edge 16 with the wedge shaped portion of the side edge received in a groove 118 defined by the side edge 116 of resilient clip member 112 combined with main body 102. Because the clip member 112 is attached to main body 102 along the sloped upper edge portion 113, the lower portion of the clip, the lower part of the clip, that is, linear side edge 116 may be forced outwardly away from the main body 102 as the apparatus 100 is mounted to rail 10, in the direction of arrow A in FIG. 6, and as detailed below. Because the clip is resilient, once the linear side edge 116 passes over side edge 16 of rail 10, the side edge 116 snaps firmly back into its original position and thus secures the apparatus 100 to rail 10. Thus, in a resting position such as that shown in FIG. 4, the resilient clip 112 is in a resting position. As the apparatus 100 is mounted, the resilient clip 112 is deflected to a second position (arrow A; FIG. 6) as the side edge 116 passes over liner side edge 16 of rail 10. As the side edge 116 of clip 112 clears side edge 16 of rail 10, the clip again assumes the resting position and in this position, side edge 16 of the rail is received in groove 118.

The resilient clip member 112 is shown detail and in isolation in FIGS. 14 through 17. The clip is preferably manufactured from high quality spring steel or other equivalent resilient material. Clip 112 is an elongate member that has dimensions that correspond to the side edge of main body 102 to which the clip 112 is mounted. Referring to the cross sectional view of FIG. 17, the upper portion 150 of clip 112 conforms to the sloped upper edge portion 113 of main body 102 (See, e.g., FIG. 5) and defines the portion of the clip through which the attachment members (such as rivets 115) pass through bores 151 to attach the clip to the main body 102. Adjacent upper portion 150 is a side portion 152 that, when the clip 112 is mounted to main body 102, extends along the side 114 of the main body 102. Immediately adjacent side portion 152 is a lower portion 154, which is defined by a section that turns at approximately 90 degrees from side portion 152 and curves in a downward direction to define the edge 116. A pair of bores 156 is formed in side portion 154, which, as detailed below, are configured to accept studs that mount the release knobs 122.

The length of resilient clip 112 may be varied relative to the length of the main body 102 of apparatus 100. Thus, there is no need for the clip to extend the entire length of the main body; the clip may be shorter than the main body. Moreover, in some cases there may be more than one clip used on a single main body.

With reference now to FIG. 13, the apparatus 100 is shown in cross section mounted to a Picatinny rail 10. The clip 112 is attached to the sloped upper edge portion 113 of main body of the apparatus 100 with rivets 115. The portion of clip 112 that lies adjacent to the side 114 of the main body 102 is slightly spaced apart from the main body, the space being identified with reference number 17. It may be seen that in FIG. 13 where the apparatus 100 is mounted to rail 10, the opposed wedge shaped rails 16 and 18 of the rail 10 are received into the cooperatively configured wedge shaped grooves 110 and 118 of mount apparatus 100 with the lower portion of clip 112, that is, edge 116 in its resting position (solid lines in FIG. 13) to secure the apparatus 100 in place on the rail 10. The widest dimension of the rail 10 is between the points of wedge shaped rails 16 and 18, and the width of the apparatus 100 between the wedge shaped grooves 110 and 118 is the same as the widest dimension of the rail. But because the resilient clip may be moved from its resting position (solid lines in FIG. 13), to an extended or deflected position (as shown in phantom lines in FIG. 13), the apparatus 100 may be disconnected from the rail 10. It will thus be understood that the mount 100 is attached to the rail 10 by first placing the mount at an angle relative to the rail and such that rail 18 is received in groove 110. The mount 100 is then pressed onto the underlying rail. As the mount is pressed toward and onto the rail 10, resilient clip 112 is deflected in the direction of arrow A in FIG. 13 as the edge 116 rides over and past rail 16. Once the edge 116 passes over the rail 16, the resilient clip 112 snaps back into its resting position, securing the mount 100 to the rail 10. The mount is detached from the rail 10 by pulling the side of the mount 100 with resilient clip 112 upwardly and at an angle relative to the rail 10, thereby again deflecting the resilient clip 112 as the edge 116 passes over the wedge shaped rail 16.

As detailed below, apparatus 100 further includes a resilient centering stud 120 and one or more knobs or release knobs 122 that releasably secure apparatus 100 to the Picatinny rail 10.

Figure 21:
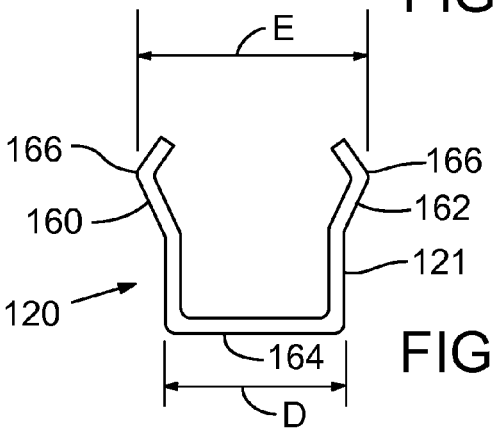
Figure 18:
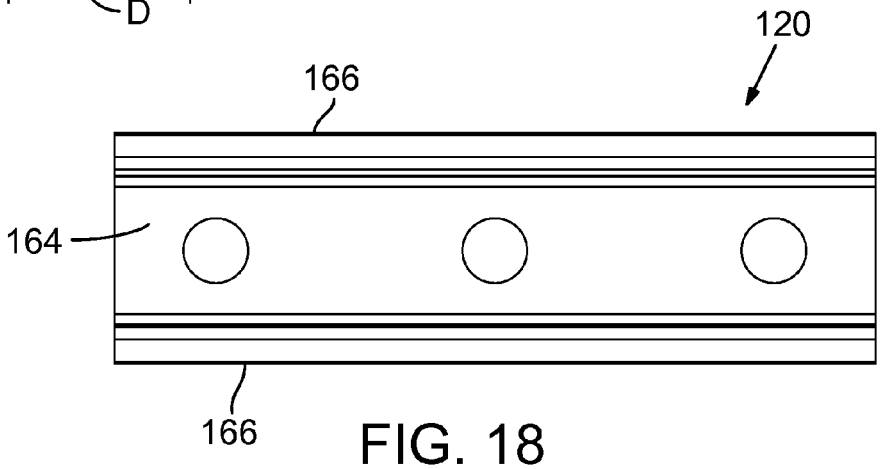
Figure 20:
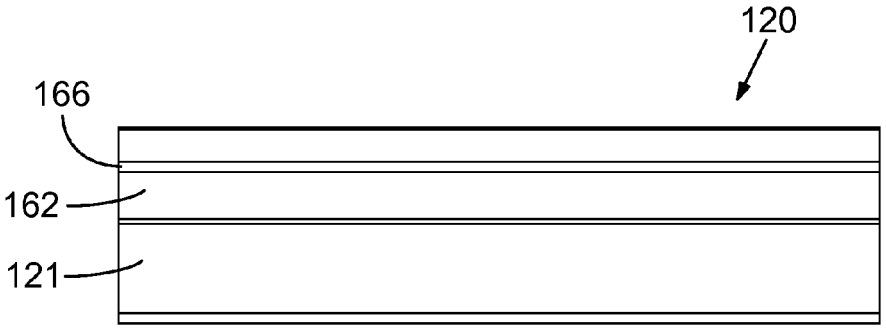

Turning now to FIGS. 18 through 21, centering stud 120 will be described. The centering stud 120 is preferably a one-piece resilient clip 121 that is mounted to the lower surface 106 of main body 102 with any suitable fastener, such as screws 124 or appropriate rivets. Clip 121 is preferably a resilient material such as spring steel. Clip 121 is mounted to the lower surface of main body 102 (i.e., the surface of the main body that faces rail 10 when the mount 100 is attached to the rail) such that the clip extends transverse to the axis of the main body (see, e.g., FIG. 8). It will be appreciated that, as detailed below, the clip 121 is configured to resistively and resiliently fit into a space 24 between transverse ridges 20 on Picatinny rail 10 when apparatus 100 is mounted to the rail. In cross sectional view such as the view of FIG. 21, clip 121 is a generally U-shaped member having opposite upright arms 160 and 162 connected by a base 164. Each of the arms 160 and 162 has an outwardly extending portion 166. The distance D in FIG. 21 is sized to fit into a space 24 of rail 10; the distance E in FIG. 21 is greater than distance D, and thus greater than the width of a space 24 of rail 10. As such, because the clip is resilient, when the apparatus 100 is mounted to rail 10 the outwardly extending portions 166 of arms 160 and 162 are compressed toward one another and the clip 121 is press-fitted into a space 24 between transverse ridges 20 on rail 10 with the outwardly extending portions 166 bearing against the opposing walls of the space 24. It will be appreciated that when the outwardly extending portions 166 of arms 160 and 162 are compressed toward one another and the clip 121 is press-fitted into a space 24 between transverse ridges 20 on rail 10 with the outwardly extending portions 166 bearing against the opposing walls of the space 24, the mount apparatus 100 is incapable of longitudinal movement on rail 10. The centering stud 120 thus functions as a zeroing apparatus and a stop.

Turning now to the series of illustrations of FIGS. 22 through 37, the release knobs 122 will be detailed, both in structure and operation. Generally speaking, each release knob 122 is specially designed to lock or secure the resilient clip 112 in a first or secured position when the mount apparatus 100 is mounted on a rail 10 to prevent the mount from being removed from the rail 10 unintentionally. The release knob in its secured position cannot be unintentionally spun loose. This is accomplished by having a knob that is spring loaded so that the release knob is normally in a free spin position. When the mount apparatus 100 is to be removed from the rail 10, the knob may be pulled outwardly. As it is pulled, the knob engages with an internal gear which enables the knob to be spun away from the resilient clip 112, thereby allowing the clip to be moved from its secured position to an unsecured position, from which the apparatus 100 may be detached from rail 10. All of the components of the release knob 122 are fabricated from appropriate materials such as stainless steel or other alloys.

Each release knob 122 comprises several components, including a stud or bolt 200 (exemplarily shown in FIGS. 8, 9, 10 and 22, and in isolation in FIGS. 35, 36 and 37); a slip barrel 204 (shown in isolation in FIGS. 29, 30 and 31); a gear knob 206 (shown in isolation in FIGS. 32, 33 and 34); and various parts described below that are used with these components.

Figure 35:
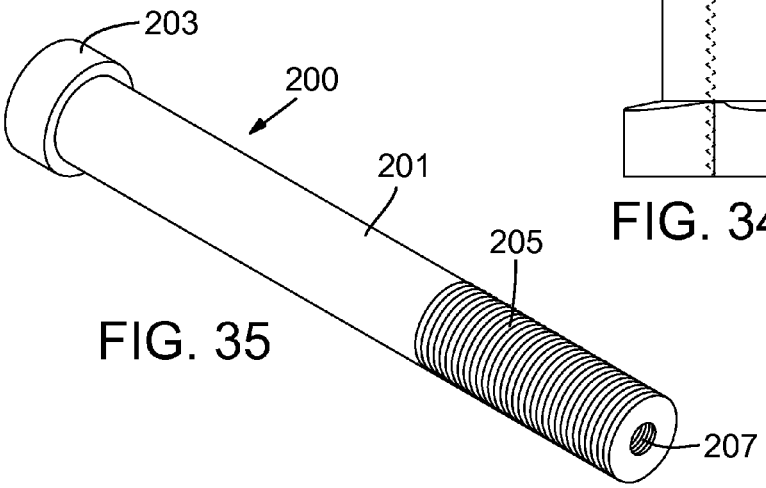
FIGS. 35 through 38 are a series of views of the stud used with release knobs 122. Specifically.
Figure 36:
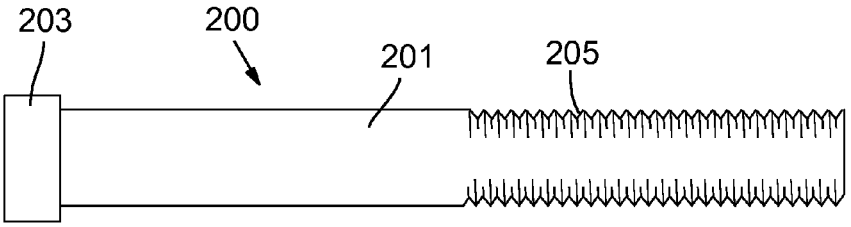
Figure 37:
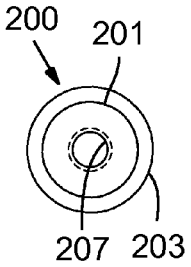

With reference to FIGS. 35, 36 and 37, bolt 200 is defined by a shaft 201 that has and enlarged head 203 on one end, a threaded portion 205 on the end of the shaft 201 opposite head 203, and an internally threaded bore 207 in the end of the bolt opposite head 203. Bolt 200 is press fit into main body 102 of mount 100 transverse to the longitudinal axis of the body such that the bolt extends through openings 202 in the main body (see, e.g., FIG. 8) and so that the bolt is fixed relative to the main body. When the bolt 200 is attached to main body 102, the treated portion 205 of bolt 200 extends outwardly of the main body.

Each release knob 122 further comprises a cylindrical slip barrel 204 (see, e.g., FIGS. 29, 30 and 31) that defines the portion of release knob 122 that the user manipulates to operate the knob. Although not shown in the illustrations in order to simplify the views, the external surface of the slip barrel 204 may be knurled or otherwise treated to make it easier for a user to manipulate. The slip barrel 204 is generally described as a cylindrical member that has an internal shelf 210 that includes plural lobes 212 that, as detailed below correspond to the size, position and shape of multiple lobes of the gear knob 206. As detailed below, the plural lobes 212 of shelf 210 interact with the plural lobes of the gear knob in order to facilitate operation of the release knob. The internal shelf 210 defines a ledge 221, the purpose of which is detailed below.

The gear knob 206 is retained within the interior of the slip barrel 204 in the assembled release knob 122, as detailed below. Each gear knob 26 is defined by a cylindrical shaft 215 that has an inward end 213 with an axial and internally threaded opening 211, and at the opposite end of the shaft 215 is a multi-lobed portion 208 that has multiple lobes 209. The relative directional term "inward" refers to the direction from the end 213 toward the main body 102.

Figure 22A:
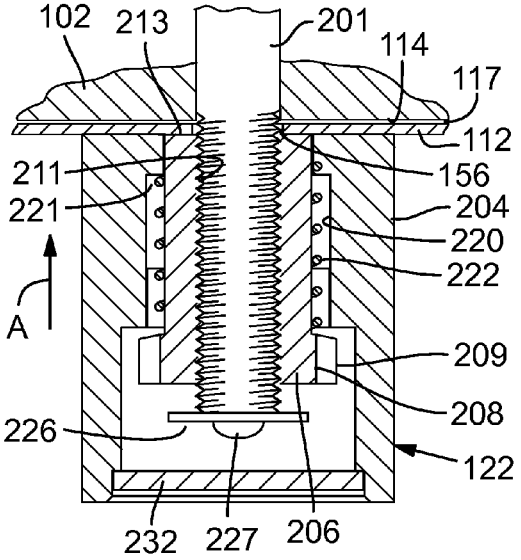
FIG. 22A is a cross sectional view through a release knob, showing the knob in its normal resting position in which the knob is in a free-spin configuration whereby axial rotation of the knob has no effect on the locking, securing features of the release knob.
Figure 24:
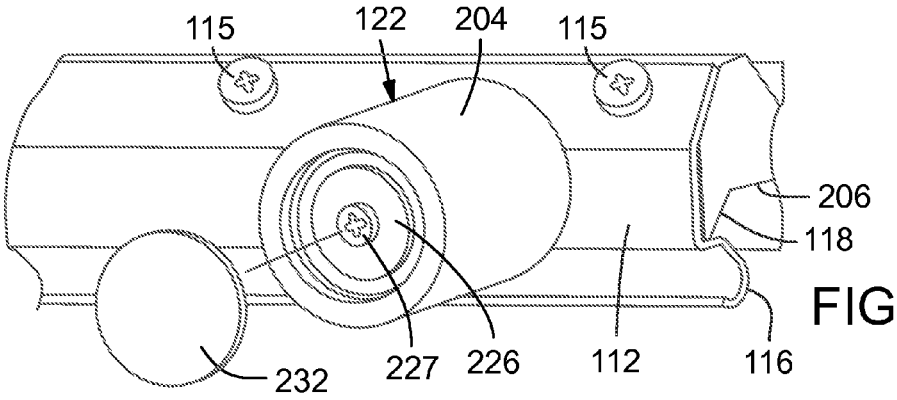
Figure 25:
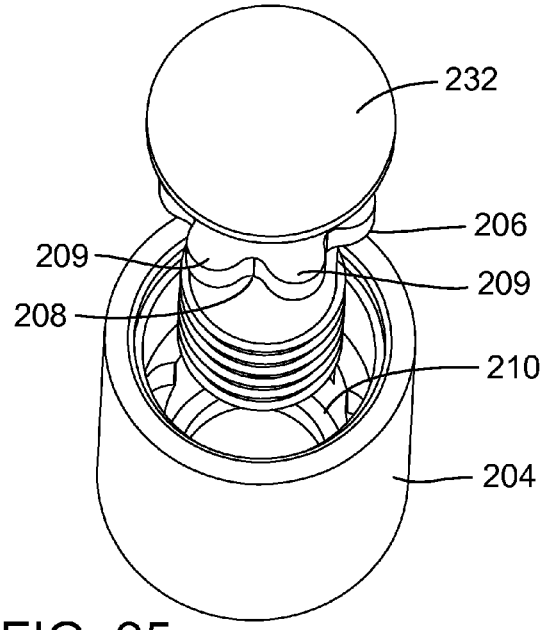
Figure 26:
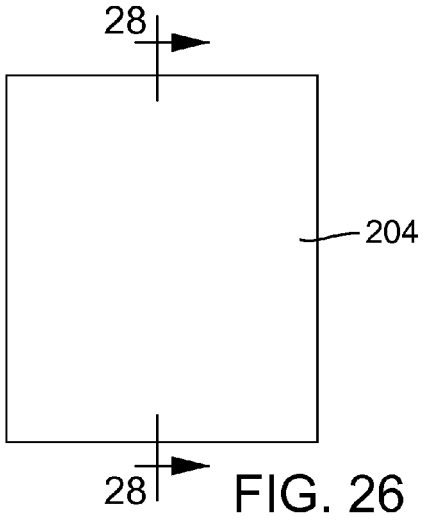
Figure 27:
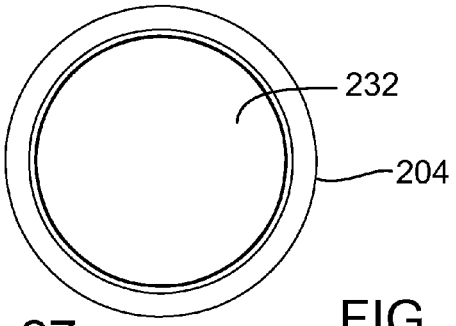
Figure 28:
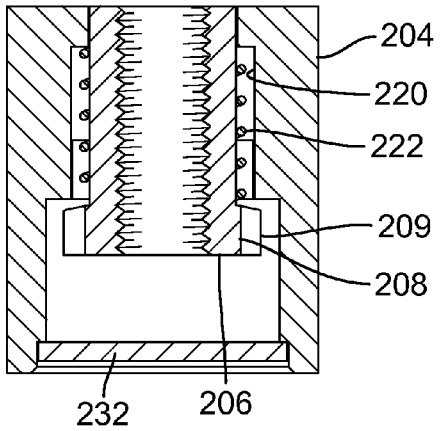
Figure 31:
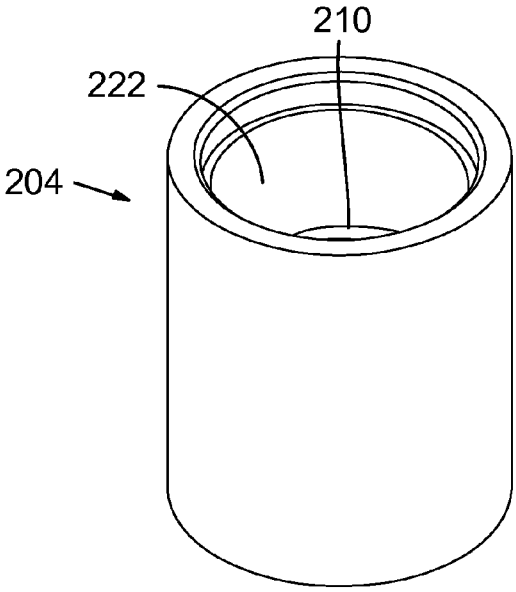
Figure 29:
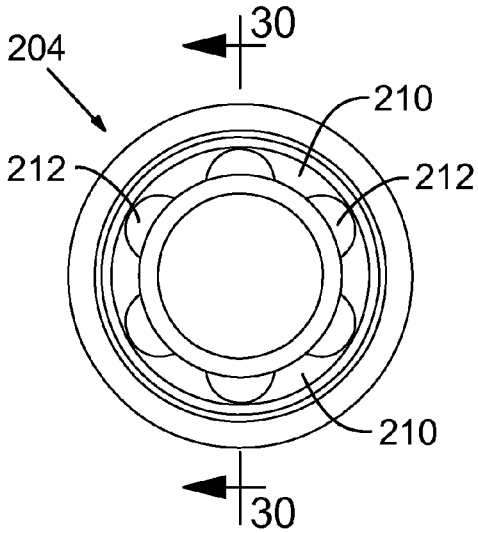
Figure 30:
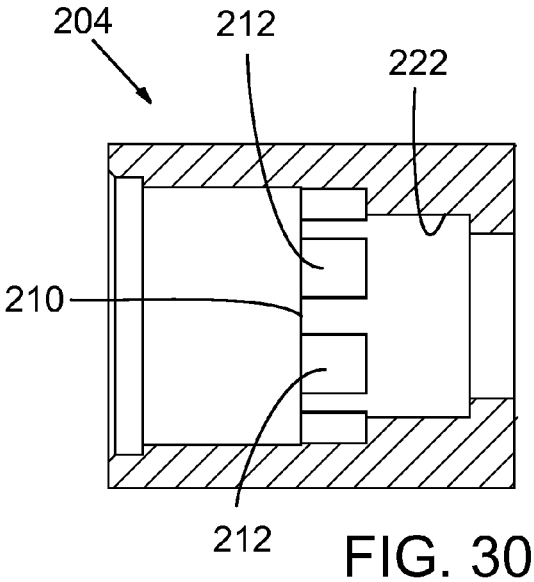
Figure 33:
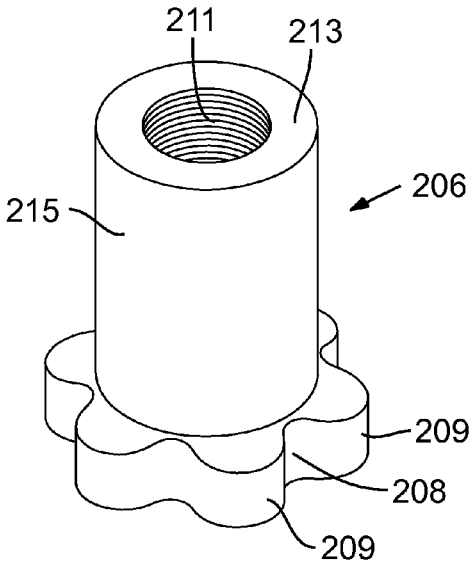
Figure 32:
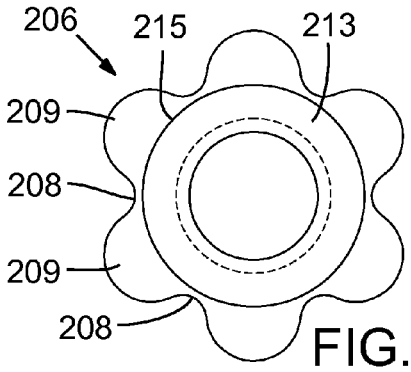
Figure 34:
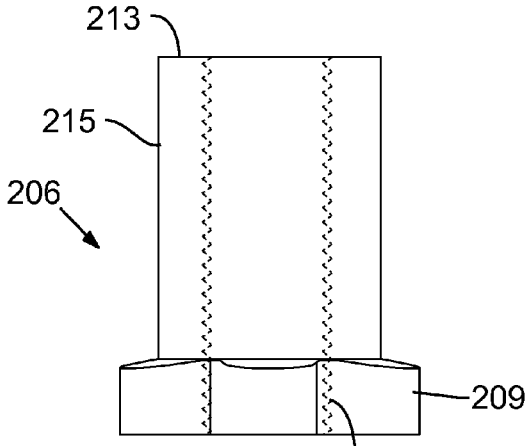

Using the three primary components just described, the release knob 122 is assembled as best seen in FIGS. 22A and 2B. A coil spring 222 is placed around the cylindrical outer portion of shaft 215 of gear knob 206 and the gear knob 206 and spring are inserted into the slip barrel 204 such that the coil spring 222 resides in a cylindrical cavity 220 In the slip barrel—the cavity 220 is bounded by a ledge 221 on the slip barrel so that the spring is retained between the ledge 221 on one end, and the lobes 209 on the opposite end. The gear knob is then threaded onto the threaded portion 205 of bolt 200 that extends outwardly of main body 202. That is, the internally threaded opening 211 of gear knob 206 is threaded onto threaded portion 205. A washer 225 (see FIGS. 8, 9) may optionally be placed between the inward end 213 of the gear knob and main body 102 prior to attachment of the gear knob to the bolt. With gear knob 206 threaded onto bolt 200 as described, a keeper 226 is placed over the outward end of gear knob 206 and a screw 227 is threaded into threaded opening 207 of bolt 200—the keeper prevents unintentional disassembly of the knob from the bold. An outer cap 232 is optionally snap fit into the exterior of the slip barrel 204 as seen in FIG. 24. The cap 232 prevents dirt and debris from entering the release knob 122 and completes the assembly.

In the assembled release knob 122 the spring 222 normally bears against and pushes the slip barrel 204 toward the clip 112 of main body 102. Stated in another way, in a resting position the innermost surface of the slip barrel 204 is urged in the direction toward the clip 112, as shown with arrow A in FIG. 22A. In this normal or resting position, the spring 222 is pushing the slip barrel 204 and its lobed shelf 210 away from the multi-lobed portion 208 of gear knob 206 such that the lobes of the gear knob are normally disengaged from the lobes of the shelf. In this position, slip barrel 204 may be axially rotated freely and without affecting the release knob 122. That is, in this free-spin position rotation of the slip barrel 204 does not cause rotation of the gear knob 206. It will be appreciated that in FIG. 22A the release knob 122 is shown in the secure position. That is, the inner edge 213 of gear knob 206 is bearing against clip 112. In this position the clip cannot be moved away from the main body 102 of apparatus 100 and as a result, the apparatus 100 cannot be removed from the rail 10 (assuming that the apparatus 100 is attached to a rail 10). Even though the inner edge 213 of gear knob 206 is bearing against clip 112, there is still a space 17 between the main body 102 and the clip 112. Said another way, while the gear knob 206 screwed tightly into the secured position, the gear knob does not compress the clip against the main body enough to close the space 17.

Figure 10:
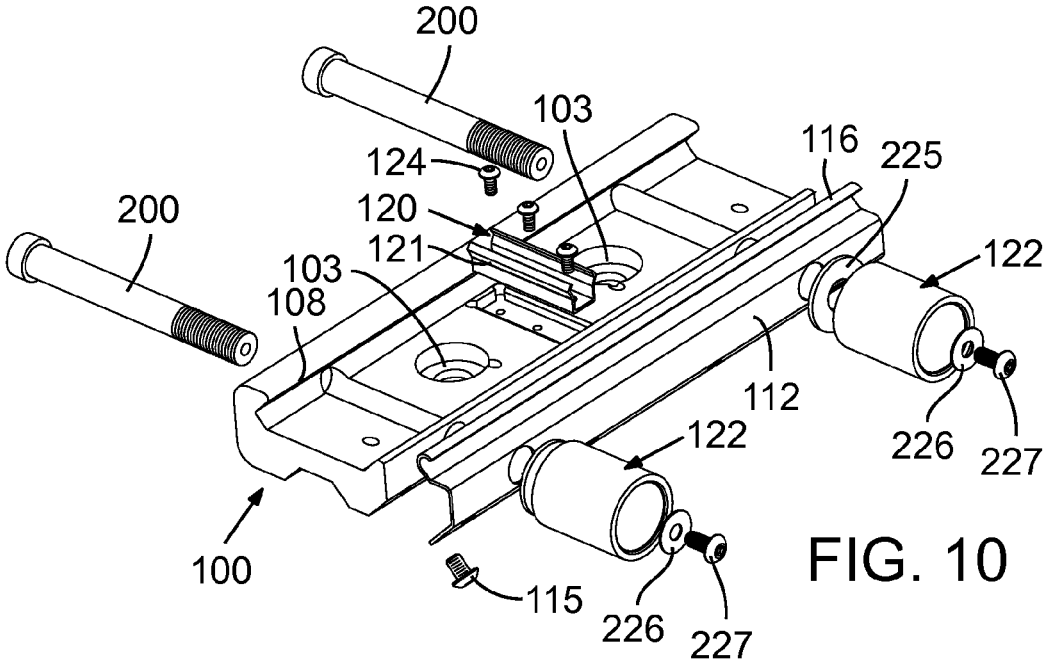
FIG. 10 is a perspective exploded view of the lower side of the mounting apparatus according to the present invention that is shown in FIG. 9.
Figure 11:
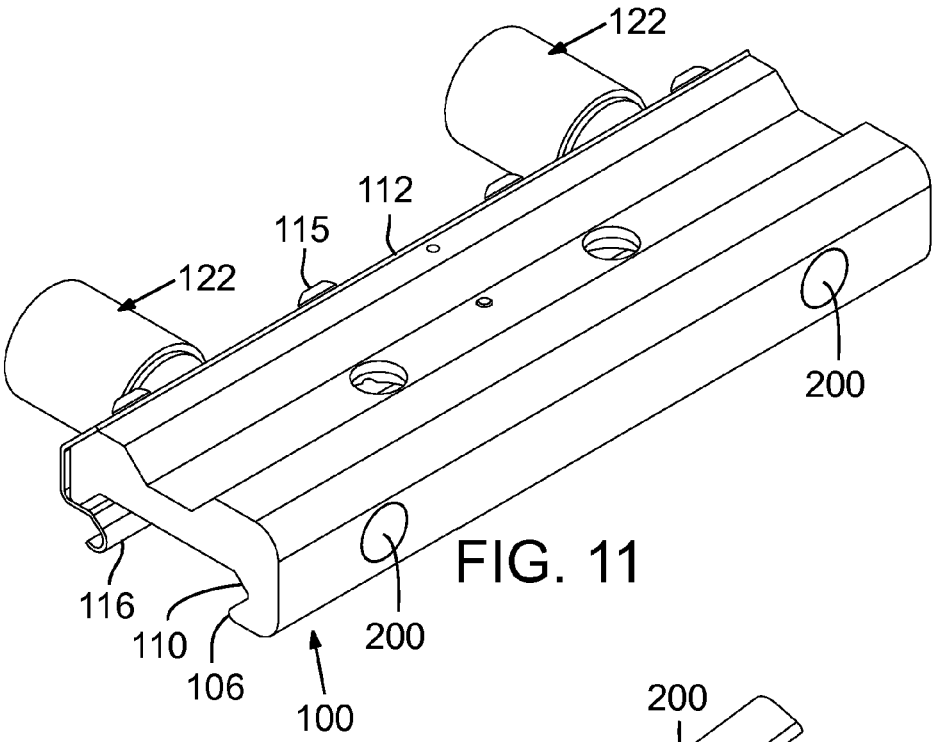
FIG. 11 is a perspective upper view of a mounting apparatus according to the present invention.
Figure 12:
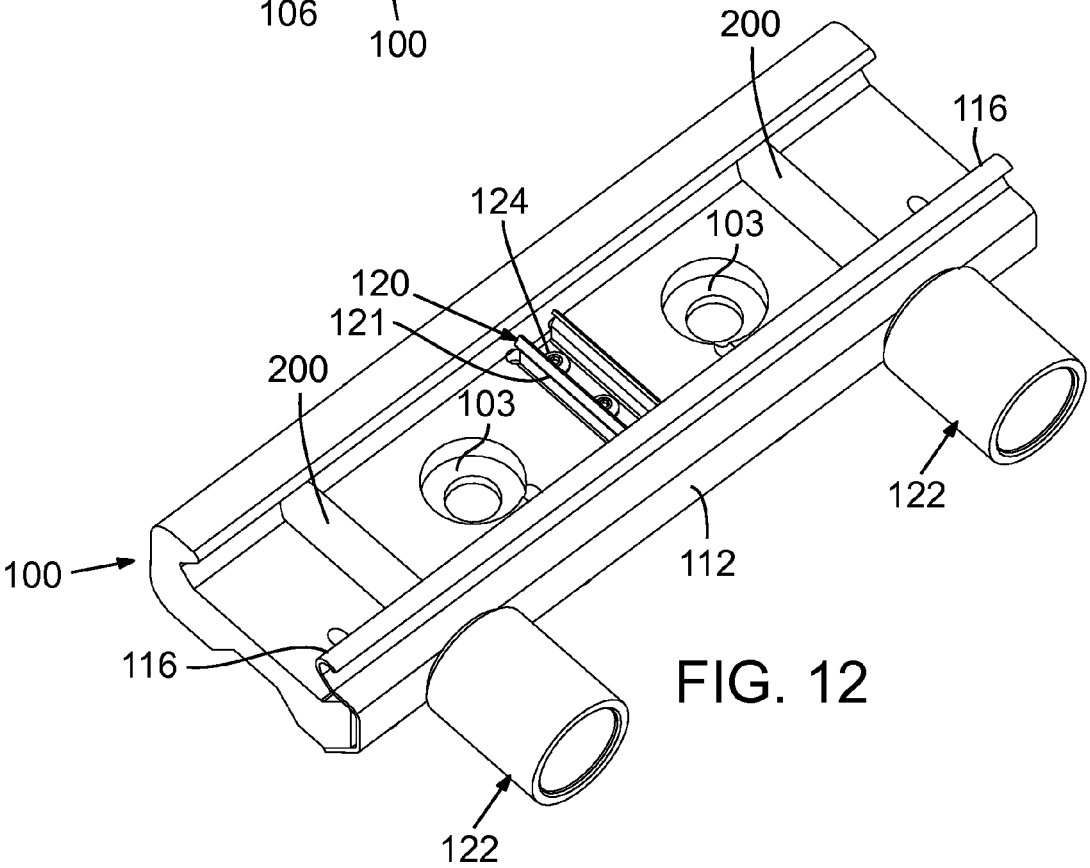
FIG. 12 is a perspective bottom view of the mounting apparatus according to the present invention shown in FIG. 11.

When slip barrel 204 is pulled outwardly (i.e., away from the main body 102, arrow B in FIG. 22B), against the spring force of spring 222, the spring is compressed and the lobes 209 of gear knob 206 mesh with and engage the lobes 212 of shelf 210 (of slip barrel 204). Once the lobes 209 engage lobes 212, axial rotation of slip barrel 204 causes gear knob 206 to rotate on bolt 200, which as noted, is fixed relative to main body 200. Thus, by pulling slip barrel 204 outwardly to engage the lobes 209 and 212 (which act as intermeshed gears), the release knob 122 may be tightened by rotation the slip barrel in a clockwise direction, which rotates the gear knob on the threaded end of bolt 200. This causes the innermost edge 213 of the gear knob 206 to bear against the resilient clip 112 and as the gear knob is tightened against the clip, the innermost edge 213 thereby prevents the clip from being movable from its resting, locked position. With reference to FIG. 13, the clip 112 is secured in the position shown in solid lines when the release knob 122 is tightened into the secured position. If a washer 225 is used as shown in FIG. 10, the washer is between the innermost edge 213 and clip 112. In either case, with the release knob 122 tightened as just described, the clip 112 is in the secured position and the mount 100 cannot be removed from its attachment with the rail 10 because the clip 112 cannot be moved or deflected away from the main body 102. Once the slip barrel is released, the spring force of spring 222 drives the slip barrel 204 toward main body 102 to disengage the lobes 209 and 212—that is, back to the free-spin position.

Engaging the gears (i.e., lobes 209, 212) once again by pulling the slip barrel outwardly (arrow B, FIG. 22B) and rotating the slip barrel in the opposite direction—the counterclockwise direction—loosens (i.e., unscrews) the gear knob 206 from the threaded portion 205 of bolt 200, and thereby moves the innermost edge 213 of the gear knob away from the clip 112 (FIG. 22C) so that the gear knob is no longer bearing against the clip 112 and edge 213 is spaced apart from clip 112. In this position the clip 112 is movable in the direction of arrow A (FIG. 13) and thus over its engagement on rail 10 to thereby allow the mounting apparatus 100 to be removed from rail 10. Typically, two complete rotations of the slip barrel in the loosening direction (i.e., counterclockwise) is enough to provide sufficient distance between the innermost edge 213 of gear knob 206 and resilient clip 112 for movement of clip 112 sufficiently that the mount apparatus 100 may easily be removed from the rail 10. It will be appreciated that even in this unsecured position the mount 100 will remain in place on rail 10 until the mount is forcibly removed. The keeper 232 acts as a stop to prevent gear knob 206 from being unscrewed from bolt 200.

Figure 22B:
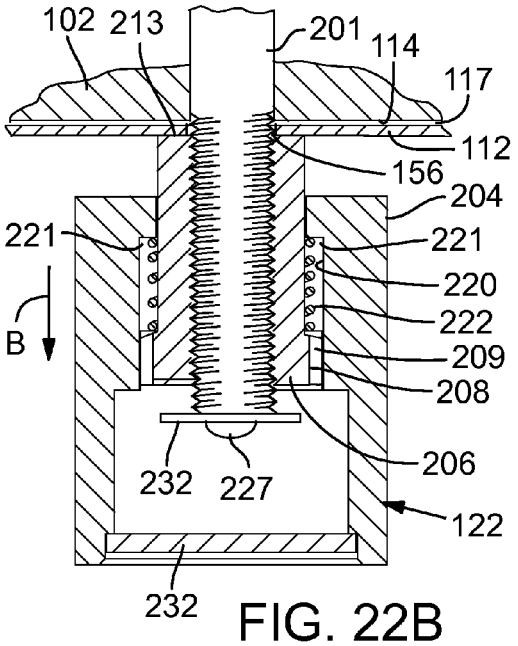
FIG. 22B is a cross sectional view through a release knob similar to the view of FIG. 22A but illustrating the knob in its engaged position in which the release knob may be axially rotated to actuate the locking, securing features of the release knob.
Figure 22C:
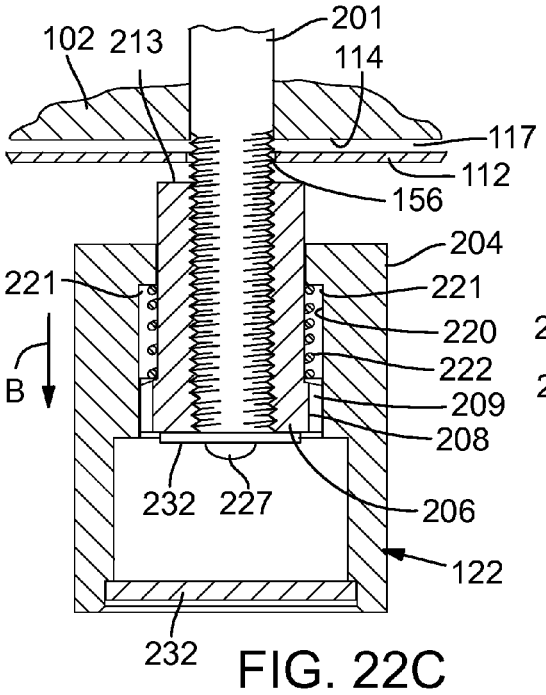
FIG. 22C is a is a cross sectional view through a release knob similar to the views of FIGS. 22A and 22B, except showing the release knob in the unsecured position from which the mount apparatus may be removed from the rail to which it is attached.
Figure 23:
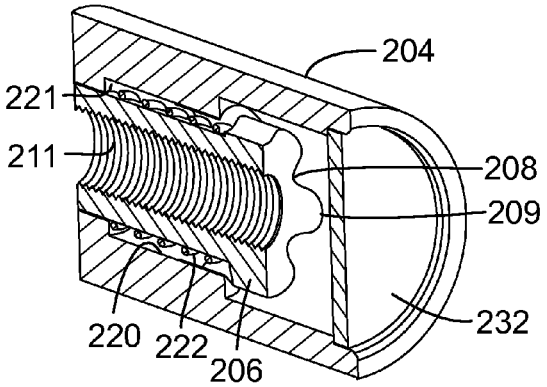

Based on the foregoing description it will be understood that the release knob 122 is in its normal, free-spin mode (FIG. 22A) whenever a user is not pulling the slip barrel outwardly and into the position shown in FIG. 22B. The release knob may thus be in the free-spin position when the knob is in its secured mode—that is, when the knob 122 is locking the clip 112 so that the mount 100 may not be removed from rail 10 (FIG. 22A), and when the knob is in its unsecured mode as shown in FIG. 22C.

In the normal, free-spin position, with the mounting apparatus 100 mounted to a rail 10 and the release knob 122 in the secured position, the mounting apparatus 100 cannot be removed from rail 10 because clip 112 cannot be moved from its normal, resting and locked position to allow the clip to move over the edge 16 of the rail 10. As such, even when the release knobs 122 hit external objects in normal use and abuse, the mounting apparatus 100 and any accessory mounted to it remain secured to the rail 10.

After removal, with the release knob (or knobs) in the unsecured position, the mounting apparatus 100 may be quickly remounted onto rail 10 by first engaging edge 108 of main body 102 over edge 18 of the rail (by tilting the main body 102 at an angle relative to the rail 10), then pressing downwardly on the opposite side of main body 102 so that clip 112 and edge 116 slides over edge 16 of the rail. Centering stud 120 is automatically inserted resiliently and resistively into a space 24 between transverse ridges 20. The apparatus 100 is then secured or locked into place on the rail 10 by pulling slip barrel 204 outwardly (to engage the gears defined by lobes 209 and 212) and then rotating the barrel in the clockwise direction to tighten the release knob 122 into the secured position with inner edge 213 bearing against clip 112.

The quick mount system defined by the resilient clip 112 and the selective release knobs 122 allows the apparatus 100 to be securely mounted to a Picatinny rail so that the mount does not separate from the rail, even when used in harsh conditions, yet allows the mount to be quickly removed. Because the centering stud 120 always (and automatically) is inserted between two adjacent transverse ridges 20, the mounting apparatus 100 is always mounted in the same position relative to the rail (although the centering stud may not always "land" in the same space 24 between ridges 20 each time the apparatus 100 is mounted). As a result, the sighting zero is precisely and accurately repeated even when the mounting apparatus (and the attached accessory) are attached to and detached from the rail 10 multiple times.

As noted previously, the upper surface 104 of main body 102 may take on a variety of different configurations depending on the specific accessory that is being mounted to the apparatus 100. While the upper surface is preferably generically configured to universally mount a variety of accessories of the type described above, sometimes special configurations are necessary.

Figure 38:
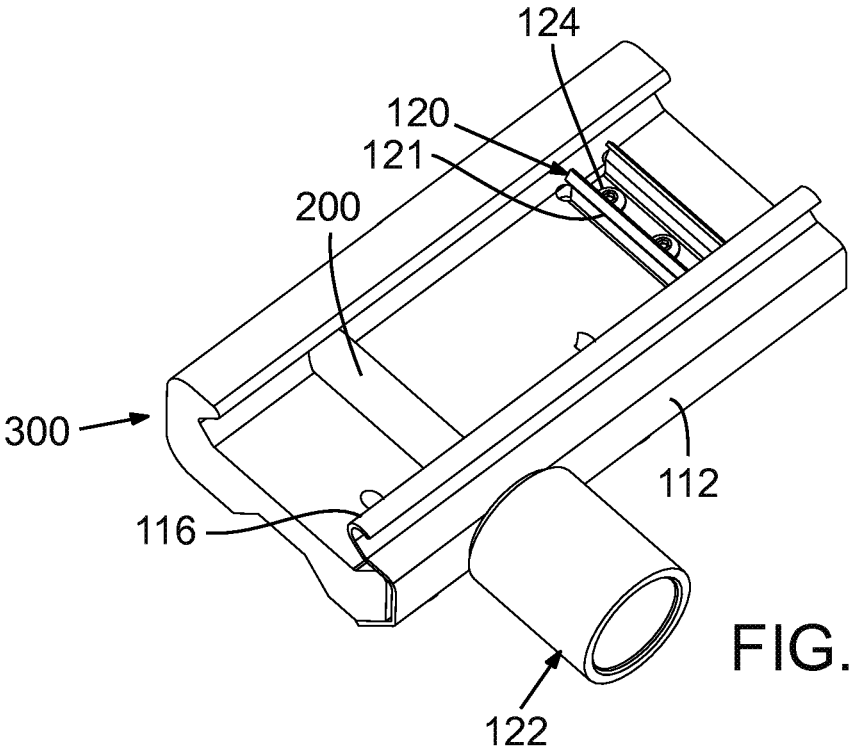
Figure 39:
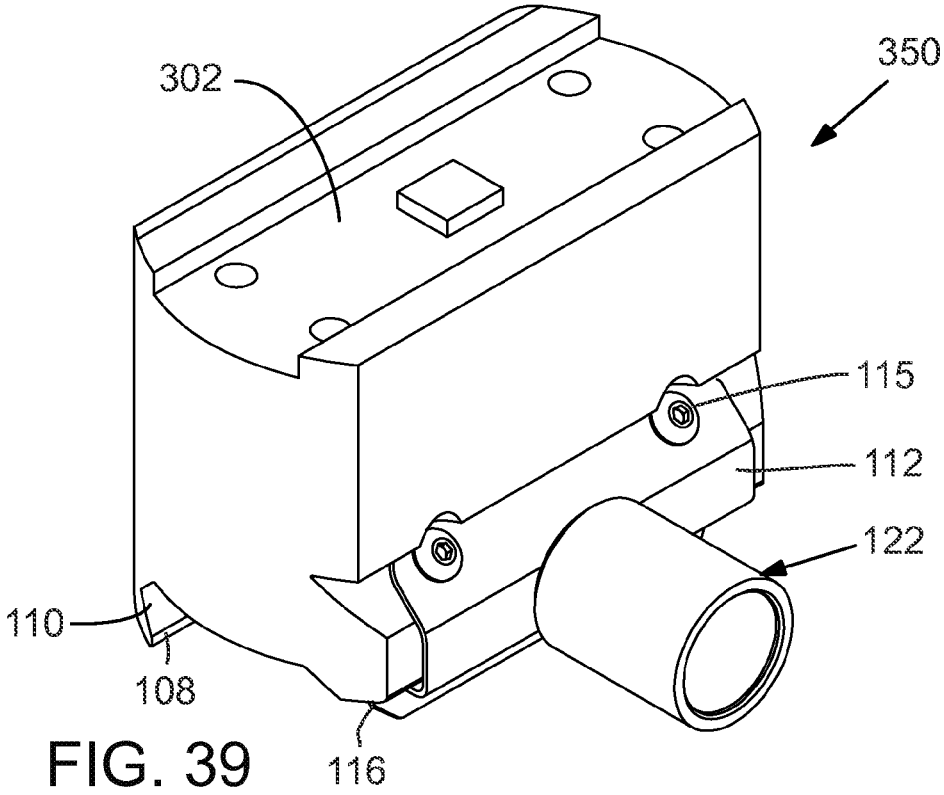
FIGS. 39 and 40 are views of two alternative embodiments of the mounting apparatus according to the present invention, each of which is configured for mounting a specific type of apparatus to the mount. Specifically.
Figure 40:
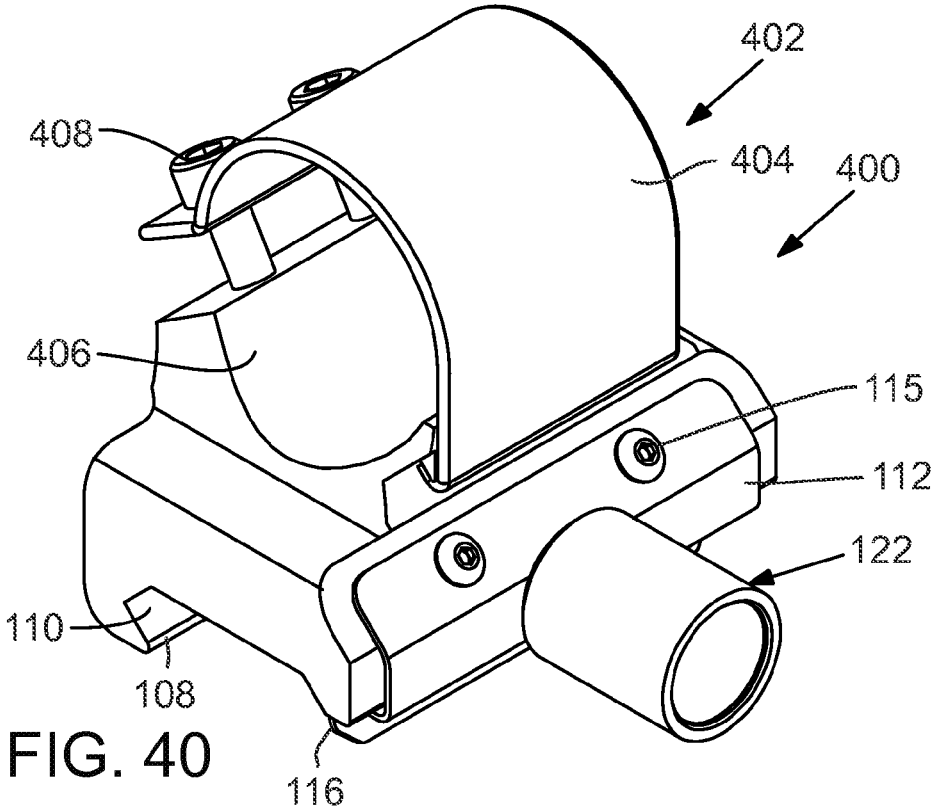

As shown in FIGS. 38, 39 and 40, the mounting apparatus according to the present invention may take on numerous sizes and configurations depending upon the particular accessories that are going to be mounted to the rail. With respect to FIG. 38, only one release knob 122 is utilized and the length of the apparatus 300 is relatively shorter than the embodiments described elsewhere. With reference to FIG. 39, the mount 350 is especially configured so that the upper portion 302 of the mount is adapted for mounting a specific device, in this case a sight sold under the trademark AIMPOINT, Micro T-1. And in FIG. 40 the upper portion 402 of the mount 400 is configured to mount a flashlight such as the light sold under the trademark HALO. Thus, a semicircular retainer 404 in combination with a semicircular seat 406 defines a clip into which the cylindrical body of the flashlight may be slid and secured in place with retaining bolts 408, which tighten the clip around the flashlight body.

It will be appreciated that there are numerous other equivalent structures that may be used to substitute for structures detailed herein, such as the release knobs. To cite just a few examples, a mount 100 according to the present invention could have resilient clips such as clip 112 along both lateral side edges of the main body of the mount.

While the present invention has been described in terms of a preferred embodiment, it will be appreciated by one of ordinary skill that the spirit and scope of the invention is not limited to those embodiments, but extend to the various modifications and equivalents as defined in the appended claims.

I claim:

1. Apparatus for mounting an accessory to a weapon rail, comprising:

a main body having an upper surface adapted for mounting the accessory to the main body, and the main body having a lower surface with a first weapon rail retaining member along one side of said main body lower surface and a second weapon rail retaining member along an opposite side of said main body lower surface, said second weapon rail retaining member defining an elongate resilient clip having an upper portion attached directly to said main body, wherein the direct attachment of said resilient clip to the main body defines a resilient hinge, and wherein a lower portion of said resilient clip is movable from a resting position in which a lower portion is retained adjacent the main body and a second position in which said lower portion may be spaced away from the main body; and a securing member defined by a bolt fixed to the main body and extending transverse to the first and second weapon rail retaining members, said bolt having a threaded portion extending outward from the main body and through the resilient clip;

a gear knob threaded onto the threaded portion of the bolt and having an inner edge facing the resilient clip and plural gear lobes on the end of the gear knob opposite the inner edge;

a spring-loaded slip barrel with an internal cavity for housing the gear knob, the slip barrel having plural gear lobes:

wherein the slip barrel is selectively movable from a first position in which the slip barrel plural gear lobes are disengaged from the gear knob plural gear lobes, and a second position in which the slip barrel plural gear lobes are engaged with the gear knob plural gear lobes;

wherein said securing member is adapted for securing the resilient clip in the resting position and to thereby prevent the resilient clip from moving to the second position, said securing member movable between a first position in which the securing member may be adjusted to selectively lock and unlock the resilient clip and a second position in which the securing member may not be adjusted, said securing member normally in the second position.

2. The apparatus according to claim 1 wherein the weapon rail includes first and second elongate spaced apart and wedge shaped side rails and plural spaced apart ridges extending transverse to the side rails, and wherein the first weapon rail retaining member defines an elongate wedge shaped member that is configured to cooperatively engage the first wedge shaped side rail of the weapon rails.

3. The apparatus according to claim 2 wherein the second weapon rail retaining member is configured to cooperatively engage the second wedge shaped side rail of the weapon rails.

4. The apparatus according to claim 3 in which when the second weapon rail retaining member is in the second position the second weapon rail retaining member may be disengaged from the second wedge shaped side rail of the weapon rails.

5. The apparatus according to claim 2 including centering stud mounted to the lower surface of the main body and extending transverse to the longitudinal axis of the main body, said centering stud comprising a resilient and elongate member adapted for cooperative engagement between spaced apart ridges of the weapon rail and having a substantially U-shaped cross sectional configuration with opposed arms that define a width that is greater than the space between adjacent ridges.

6. The apparatus according to claim 5 wherein the opposed arms are compressed together when the centering stud is engaged between spaced apart ridges.

7. The apparatus according to claim 1 wherein the securing member is in the second position when the slip barrel is in the first position.

8. The apparatus according to claim 7 wherein when the securing member is in the first position the slip barrel may be rotated to move the inner edge of the gear knob against the resilient clip and away from the resilient clip.

* * * * *